US012025392B2

(12) United States Patent
Muska

(10) Patent No.: US 12,025,392 B2
(45) Date of Patent: Jul. 2, 2024

(54) SEAR AND HAMMER ARRANGEMENT

(71) Applicant: Smith & Wesson Inc., Springfield, MA (US)

(72) Inventor: Simon M. Muska, Enfield, CT (US)

(73) Assignee: Smith & Wesson Inc., Springfield, MA (US)

( * ) Notice: Subject to any disclaimer, the term of this patent is extended or adjusted under 35 U.S.C. 154(b) by 0 days.

(21) Appl. No.: 18/162,887

(22) Filed: Feb. 1, 2023

(65) Prior Publication Data

US 2023/0243609 A1 Aug. 3, 2023

Related U.S. Application Data

(60) Provisional application No. 63/305,297, filed on Feb. 1, 2022.

(51) Int. Cl.
*F41A 3/66* (2006.01)
*F41A 19/12* (2006.01)
*F41A 19/14* (2006.01)

(52) U.S. Cl.
CPC ..... *F41A 3/66* (2013.01); *F41A 19/12* (2013.01); *F41A 19/14* (2013.01)

(58) Field of Classification Search
CPC ..... F41A 19/14; F41A 19/12
USPC ..... 42/69.03
See application file for complete search history.

(56) References Cited

U.S. PATENT DOCUMENTS 1,434,328 A 10/1922 Declaye
2,465,487 A 3/1949 Sampson et al.
2,539,447 A 1/1951 Lochhead
3,292,492 A 12/1966 Sturtevant
3,318,192 A 5/1967 Sullivan et al.
3,380,183 A 4/1968 Sullivan et al.
4,522,106 A 6/1985 Sullivan
5,183,959 A 2/1993 McCoan et al.
5,635,664 A * 6/1997 Pons ..... F41A 19/44 89/154
5,713,150 A 2/1998 Ealovega
6,769,208 B2 8/2004 Beretta
6,976,416 B2 12/2005 Ealovega
7,181,880 B2 * 2/2007 Keeney ..... F41A 19/44 42/69.03
7,213,359 B2 5/2007 Beretta
10,488,136 B2 11/2019 Sullivan et al.

* cited by examiner

*Primary Examiner* — Reginald S Tillman, Jr.
(74) *Attorney, Agent, or Firm* — Ballard Spahr LLP

(57) ABSTRACT

An arrangement of a hammer and a sear for a firearm having a frame is disclosed. The arrangement includes a hammer mountable within said frame for pivoting motion about a hammer pivot axis. The hammer includes a hammer body defining a hammer lug surrounding said hammer pivot axis and a hammer face positioned distal to said hammer pivot axis. A slot is positioned within said hammer body. A catch surface is positioned on said hammer body within said slot. A sear is mountable within said frame for pivoting motion about a sear pivot axis. The sear includes a sear body defining a sear lug surrounding said sear pivot axis and an action surface positioned on said sear body distal to said sear pivot axis. The action surface is movable into and out of engagement with said catch surface upon rotation of said sear body about said sear pivot axis. At least a portion of said sear body is received within said slot.

19 Claims, 4 Drawing Sheets

SEAR AND HAMMER ARRANGEMENT

CROSS-REFERENCE TO RELATED APPLICATION

This application claims the benefit of the filing date of U.S. Provisional Patent Application No. 63/305,297, filed Feb. 1, 2022, the entirety of which is hereby incorporated by reference herein.

FIELD

This disclosure relates to a sear and hammer arrangement for firearms.

BACKGROUND

Competition among mechanisms for space within the frame (or receiver) of a firearm is heightened when ergonomic design considerations become important and take precedent. This is especially true in the design of sub-caliber carbines where internal space is at a premium and the fire control system components such as the trigger, trigger bar, trigger return and safety components vie for space against the hammer and sear and their respective springs. There is clearly an opportunity to improve the design of internal mechanisms to allow for more compact and ergonomically favorable firearm designs.

SUMMARY OF EMBODIMENTS

Disclosed herein is an arrangement of a hammer and a sear for a firearm having a frame. The arrangement comprises a hammer mountable within said frame for pivoting motion about a hammer pivot axis. The hammer comprises a hammer body defining a hammer lug surrounding said hammer pivot axis and a hammer face positioned distal to said hammer pivot axis. A slot is positioned within said hammer body. A catch surface is positioned on said hammer body within said slot. A sear is mountable within said frame for pivoting motion about a sear pivot axis. The sear comprises a sear body defining a sear lug surrounding said sear pivot axis and an action surface positioned on said sear body distal to said sear pivot axis. The action surface is movable into and out of engagement with said catch surface upon rotation of said sear body about said sear pivot axis. At least a portion of said sear body is received within said slot.

In various aspects, said hammer and said sear are mountable directly on said frame.

In some aspects, the arrangement can further comprise a housing surrounding said hammer and said sear. The hammer and said sear can be pivotably mounted within said housing. The housing is mountable within said frame. The arrangement can further comprise a hammer spring for biasing said hammer to pivot from a cocked position to a strike position, said hammer spring acting between said housing and said hammer body. In further aspects, the arrangement can further comprise a sear spring for biasing said sear to pivot from a first position wherein said action surface is not engaged with said catch surface, to a second position wherein said action surface is engaged with said catch surface, said sear spring acting between said housing and said sear body.

In some examples, said catch surface and said action surface are positioned along a centerline of said hammer body and said sear body.

In exemplary aspects, said slot extends between said hammer lug and said hammer face.

According to some embodiments, said hammer further comprises an opening extending through said hammer lug, said opening being aligned with said hammer pivot axis. A hammer pivot pin extends through said opening. The hammer pivot pin is aligned with said hammer pivot axis.

In exemplary embodiments, said sear further comprises an opening extending through said sear lug, said opening being aligned with said sear pivot axis. A sear pivot pin extends through said opening, said sear pivot pin being aligned with said sear pivot axis.

An exemplary hammer further comprises first and second hammer trunnions positioned on opposite sides of said hammer lug, said first and second hammer trunnions surrounding said hammer pivot axis. In some aspects, the arrangement further comprises a hammer spring for biasing said hammer to pivot from a cocked position to a strike position. Said hammer spring comprises a first coil surrounding said first trunnion, a second coil surrounding said second trunnion, and a bridge connecting said first and second coils. Said bridge engages said hammer body. Said first and second coils are adapted to react directly against said frame for biasing said hammer.

An exemplary sear further comprises first and second sear trunnions positioned on opposite sides of said sear lug, said first and second sear trunnions surrounding said sear pivot axis. In various exemplary embodiments, the arrangement further comprises a sear spring for biasing said sear to pivot from a first position wherein said action surface is not engaged with said catch surface, to a second position wherein said action surface is engaged with said catch surface. Said sear spring comprises a first coil surrounding said first sear trunnion and a bridge extending from said first coil and engaging said sear body. Said first coil can be adapted to react directly against said frame for biasing said sear.

In some aspects, said sear further comprises a sear tail positioned on an opposite side of said sear pivot axis from said action surface.

In some examples, the arrangement further comprises a hammer spring for biasing said hammer to pivot from a cocked position to a strike position. Said hammer spring is adapted to act directly between said frame and said hammer body.

In various embodiments, the arrangement further comprises a sear spring for biasing said sear to pivot from a first position wherein said action surface is not engaged with said catch surface to a second position wherein said action surface is engaged with said catch surface. Optionally, in these aspects, said sear spring is adapted to act directly between said frame and said sear body.

In some aspects, the arrangement can further comprise a housing surrounding said hammer and said sear. The hammer and said sear can be pivotably mounted within said housing. The housing is mountable within said frame. In some examples, said hammer further comprises first and second hammer trunnions positioned on opposite sides of said hammer lug, said first and second hammer trunnions surrounding said hammer pivot axis. In various aspects, the arrangement further comprises a hammer spring for biasing said hammer to pivot from a cocked position to a strike position. Said hammer spring comprises a first coil surrounding said first trunnion, a second coil surrounding said second trunnion, and a bridge connecting said first and second coils, said bridge engaging said hammer body. Said first and second coils react against said housing for biasing said hammer.

In some aspects, the arrangement can further comprise a housing surrounding said hammer and said sear. The hammer and said sear can be pivotably mounted within said housing. The housing is mountable within said frame. Said sear further comprises first and second sear trunnions positioned on opposite sides of said sear lug, said first and second sear trunnions surrounding said sear pivot axis. In some examples, the arrangement further comprises a sear spring for biasing said sear to pivot from a first position wherein said action surface is not engaged with said catch surface, to a second position wherein said action surface is engaged with said catch surface. Said sear spring comprises a first coil surrounding said first sear trunnion and a bridge extending from said first coil and engaging said sear body. Said first coil reacts against said housing for biasing said sear.

Also disclosed is a firearm having said arrangement of said hammer and said sear as further described herein.

DETAILED DESCRIPTION

Figure 1:
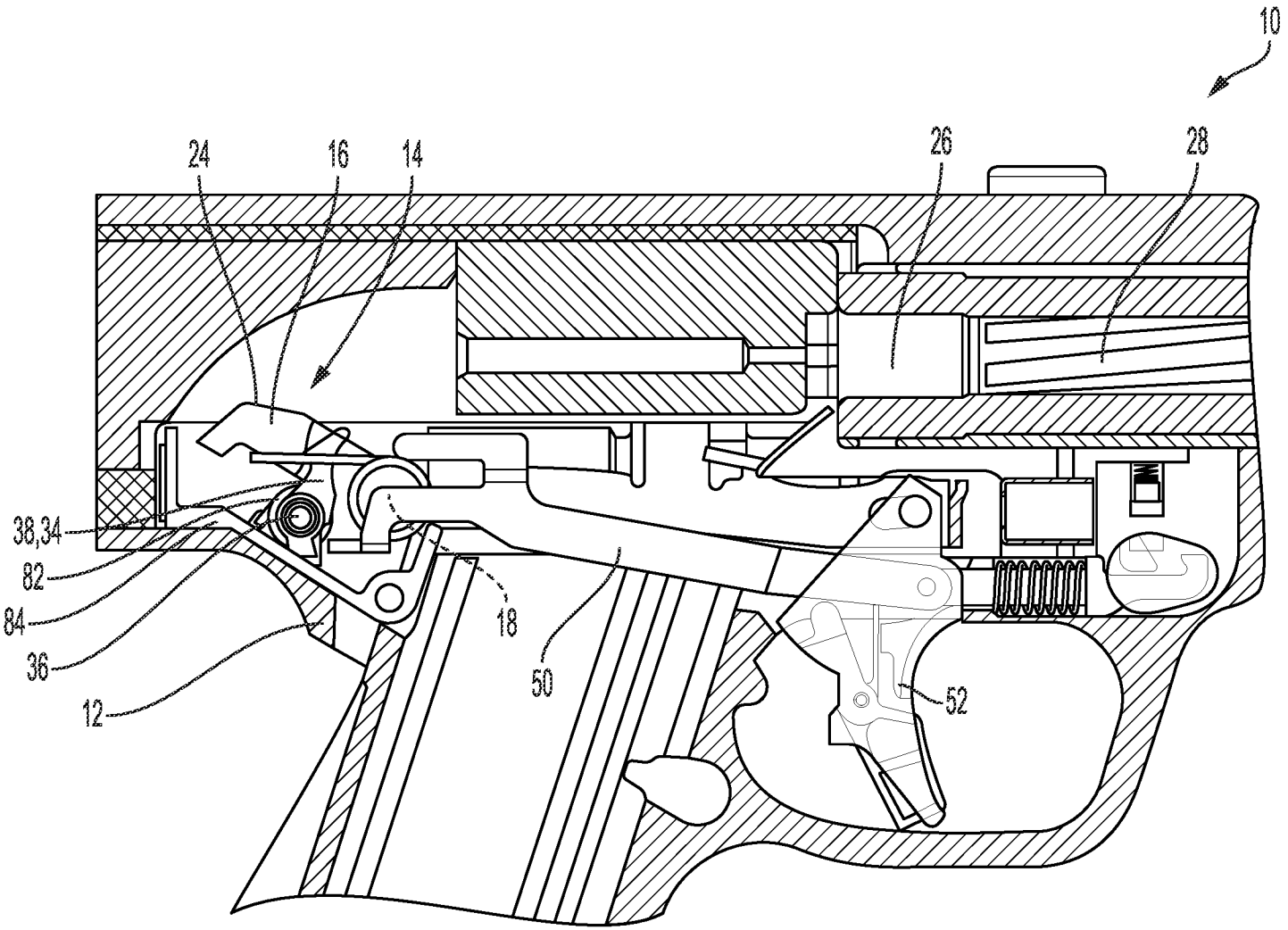
FIG. 1 is a partial sectional view of an example firearm as disclosed herein.
Figure 4:
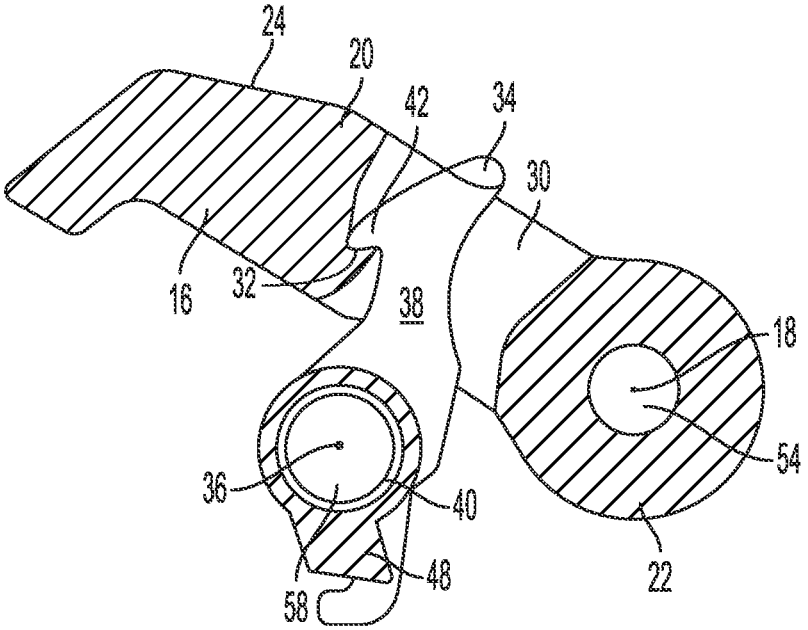
FIG. 4 is a partial sectional view of an example hammer and sear as disclosed herein.
Figure 5:
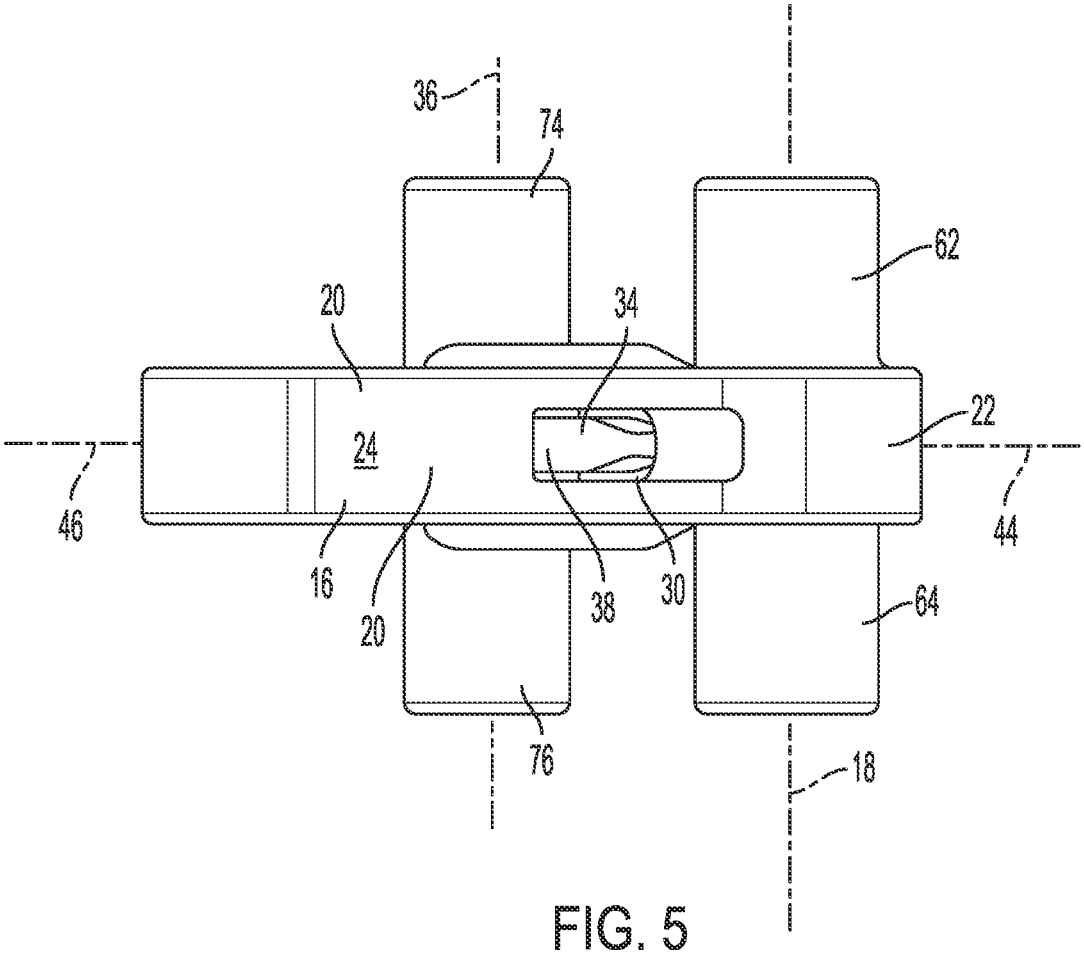
FIG. 5 is a plan view of the example hammer and sear shown in FIG. 4.

The disclosure concerns an arrangement of a hammer and a sear for a firearm, and a firearm having the arrangement of hammer and sear described herein. An example firearm 10 is shown in FIG. 1, the firearm having a frame 12 in which an example arrangement 14 is mounted. As shown in detail in FIG. 2, the arrangement 14 comprises a hammer 16 mountable within the frame 12 for pivoting motion about a hammer pivot axis 18. An example hammer 16 is shown in FIGS. 4 and 5 and comprises a hammer body 20 defining a hammer lug 22 surrounding the hammer pivot axis 18 and a hammer face 24 positioned distal to the hammer pivot axis 18. As can be deduced from FIG. 1, the hammer face 24 is designed and positioned within the frame 12 to strike an object, such as a firing pin (not shown) of the firearm 10 when the hammer 16 rotates about its pivot axis 18. In other embodiments (not illustrated), the hammer face can be designed and positioned within the frame to strike a primer of a cartridge within the chamber of barrel. FIGS. 4 and 5 show a slot 30 positioned within the hammer body 20. As shown in FIG. 4, a catch surface 32 is positioned on the hammer body 20 within the slot 30.

Arrangement 14 also includes a sear 34. As shown in FIG. 1, sear 34 is also mountable within the frame 12 for pivoting motion about a sear pivot axis 36. FIG. 4 shows an example sear 34 which comprises a sear body 38. Sear body 38 defines a sear lug 40 surrounding the sear pivot axis 36. An action surface 42 is positioned on the sear body 38 distal to the sear pivot axis 36. The action surface 42 is movable into and out of engagement with the catch surface 32 upon rotation of the sear body 38 about the sear pivot axis 36. As shown in FIG. 4, at least a portion of the sear body is received within the slot 30 of hammer 16. In this example embodiment, the slot 30 extends between the hammer lug 22 and the hammer face 24, and, as shown in FIG. 5, the catch surface 32 and the action surface 42 are positioned along a centerline 44 of the hammer body 20 and a centerline 46 of the sear body 38 respectively. Accordingly, in some aspects, a single plane can include both the centerline 44 of the hammer body 20 and the centerline 46 of the sear body 38. Said plane can bisect the hammer body and the sear body and can extend through and bisect the catch surface 32 and the action surface 42. Both the hammer body 20 and the sear body 38 are symmetric about their respective centerlines. This configuration of hammer 16 and sear 34 ensures that the hammer will not experience any significant off-axis moment (i.e., moment about axes other than the pivot axes 18 and 36) due to contact between the catch surface 32 and the action surface 42 when they are engaged, thereby minimizing any uneven engagement between sear and hammer. It is advantageous to avoid uneven engagement, which could otherwise lead to the sear action surface 42 making edge contact with the hammer catch surface 32 rather than surface to surface contact when the hammer is held in the cocked position (shown in FIG. 1). Edge contact could result in higher contact stresses, higher trigger pull forces, and uneven wear between sear and hammer during firearm operation.

Figure 2:
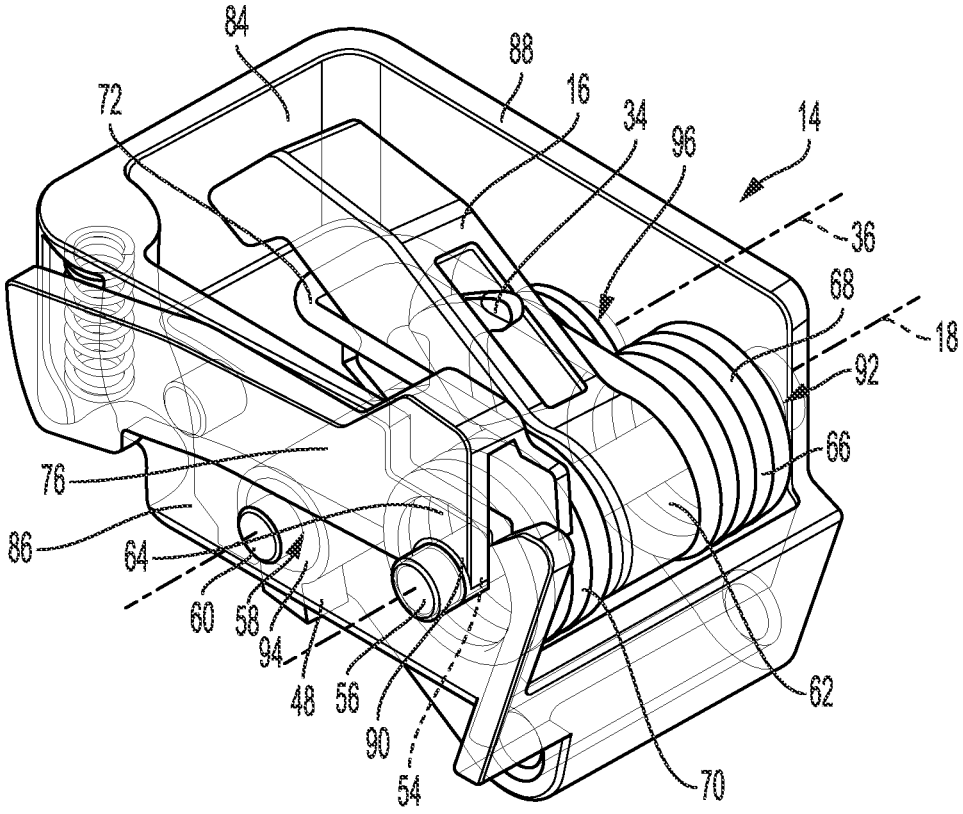
FIG. 2 is an isometric view of an example arrangement of a hammer and a sear mechanism as disclosed herein.

As shown in FIG. 4, an example hammer 16 may comprise an opening 54 extending through the hammer lug 22, the opening 54 being aligned with the hammer pivot axis 18. As shown in FIG. 2, opening 54 receives a hammer pivot pin 56 which extends through the opening and is aligned with the hammer pivot axis 18. Pivot pin 56 forms an axle for pivoting support of the hammer 16. Similarly, as shown in FIG. 4, an example sear 34 may comprise an opening 58 extending through the sear lug 40. Opening 58 is aligned with the sear pivot axis 36 and, as shown in FIG. 2, receives a sear pivot pin 60 which extends through the opening 58. The sear pivot pin 60 is also aligned with the sear pivot axis 36 and supports the sear 34 in its pivoting motion.

Figure 3:
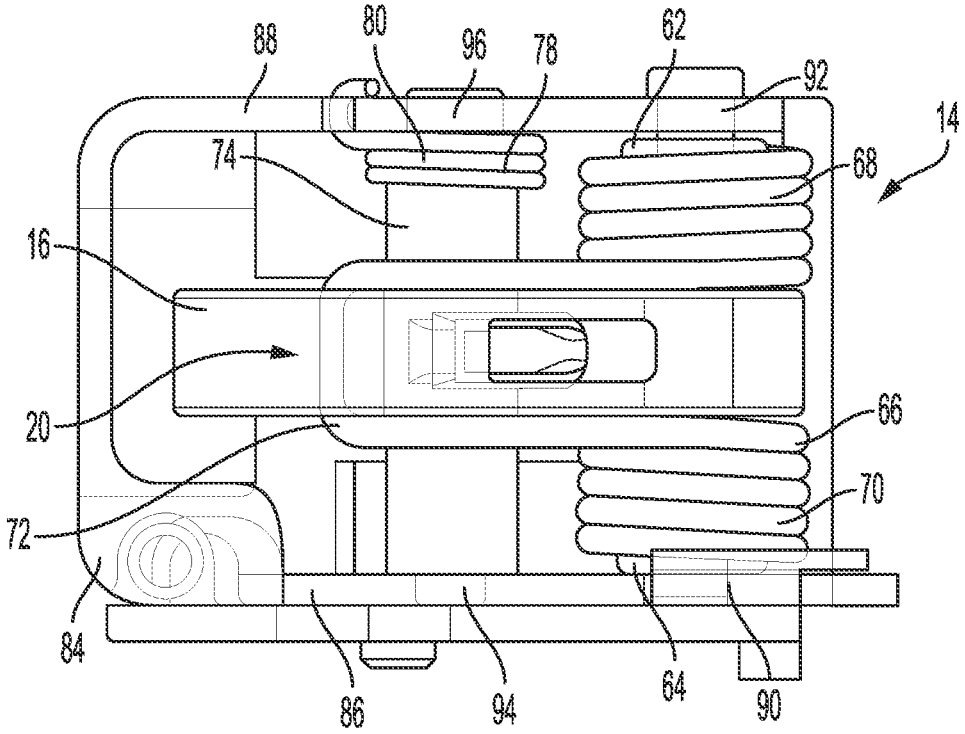
FIG. 3 is a plan view of the example arrangement of a hammer and a sear mechanism of FIG. 2.

By way of example, shown in FIG. 5, the hammer 16 may further comprise first and second hammer trunnions 62 and 64 positioned on opposite sides of the hammer lug 22. The first and second hammer trunnions 62 and 64 surrounding the hammer pivot axis 18. As shown in FIGS. 2 and 3, a hammer spring 66 is used to bias the hammer 16 and pivot it from a cocked position (shown in FIG. 1) to a strike position to discharge the firearm 10. When the hammer trunnions 62 and 64 are present as shown in FIGS. 2 and 3, the hammer spring 66 advantageously comprises a first coil 68 surrounding the first trunnion 62, a second coil 70 surrounding the second trunnion 64, and a bridge 72 connecting the first and second coils. The bridge 72 engages the hammer body 20.

As shown in FIG. 5, an example sear 34 may also comprise first and second sear trunnions 74 and 76 positioned on opposite sides of the sear lug 40 (not visible). The first and second sear trunnions 74 and 76 surround the sear pivot axis 36. As shown in FIG. 3, a sear spring 78 biases the sear 34 and pivots it from a first position, wherein the sear's action surface 42 is not engaged with the hammer catch surface 32, to a second position (see FIG. 4) wherein the action surface 42 is engaged with the catch surface 32. In this example embodiment, the sear spring 78 comprises a coil 80 surrounding the first sear trunnion 74 and a bridge 82

Figure 6:
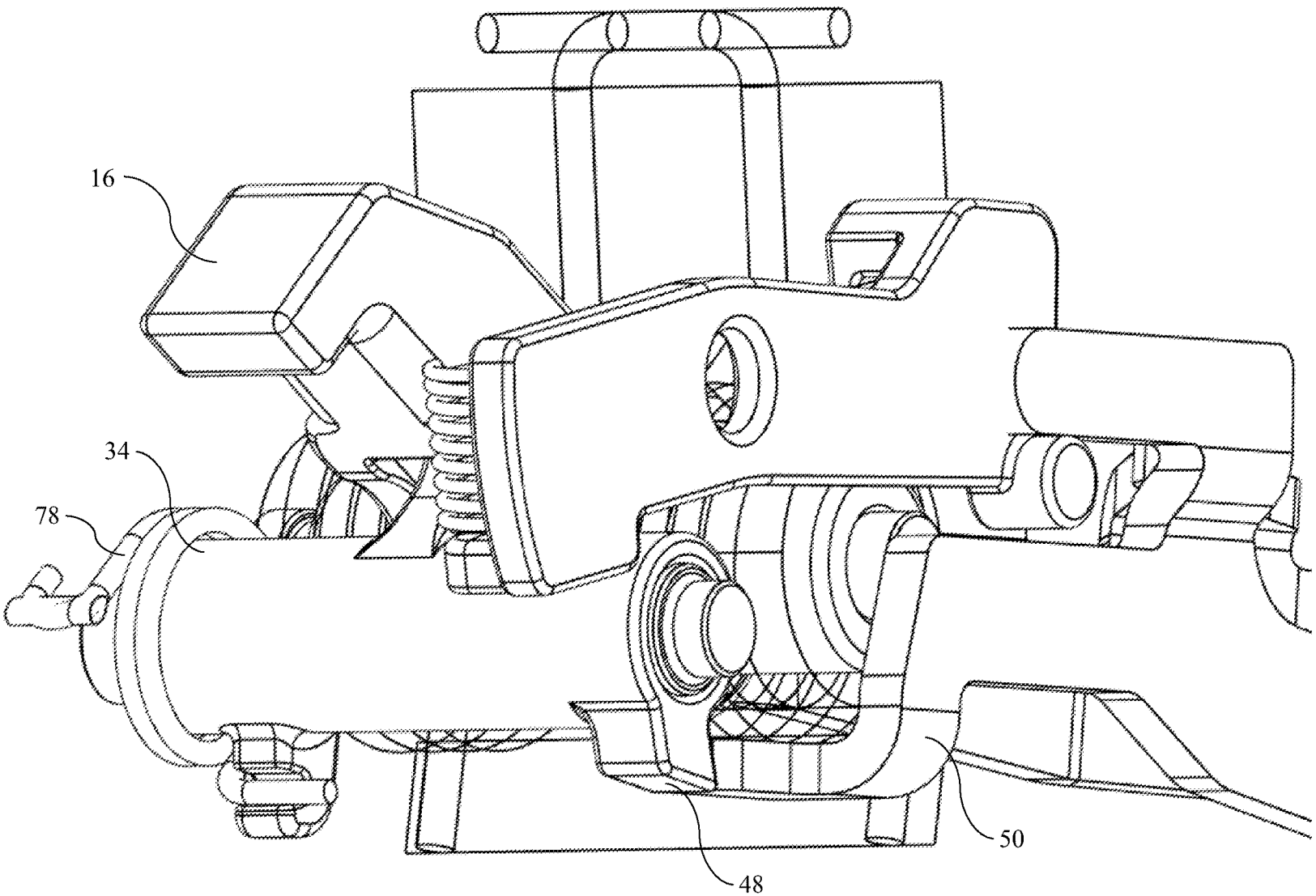
FIG. 6 shows a rear perspective view of the example firearm of FIG. 1 with various components omitted to more clearly show the depicted components.

(see FIG. 1) extending from the coil 80 and engaging the sear body 38. FIG. 2 shows a sear tail 48 extending from the second sear trunnion 76. Sear tail 48 is positioned on an opposite side of the sear pivot axis 36 from the action surface 42 as shown in FIG. 4. Sear tail 48 permits actuation (rotation) of sear 34 by, for example, a trigger bar 50 linked to a trigger 52 (see FIG. 1) to disengage the sear action surface 42 from the hammer catch surface 32 to discharge firearm 10. Referring also to FIG. 6, the trigger bar 50 can engage the sear tail 48 to apply a torque to the sear 34 to rotate the sear 34, thereby disengaging the action surface 42 from the catch surface 32.

Arrangement 14 may be mounted directly on frame 12. In this example embodiment the hammer pivot pin 56 and the sear pivot pin 60 are supported in bearings integral to the frame 12. Furthermore, the hammer spring 66 acts directly between the frame 12 and the hammer 16, and the sear spring 78 acts directly between the frame 12 and the sear 34. However, in the example embodiment shown in FIGS. 1-3, the arrangement 14 includes a housing 84. When present, housing 84 substantially surrounds the hammer 18 and sear 34. Both hammer and sear are pivotably mounted within the housing 84. The hammer pivot pin 56 is supported between first and second housing walls 86 and 88 in respective bearings 90 and 92 within the walls. Similarly, the sear pivot pin 60 is supported between the housing walls 86 and 88 in respective bearings 94 and 96 in the walls. In this example embodiment the hammer spring 66 acts between the housing 84 and the hammer 18, and the sear spring 78 acts between the housing and the sear 34. As shown in FIG. 1, the housing 84 is mounted within the frame 12. Use of housing 84 confers modularity to the arrangement 14, providing a manufacturing advantage.

What is claimed is:

1. An arrangement of a hammer and a sear for a firearm having a frame, said arrangement comprising:

a hammer mountable within said frame for pivoting motion about a hammer pivot axis, said hammer comprising:

a hammer body defining a hammer lug surrounding said hammer pivot axis and a hammer face positioned distal to said hammer pivot axis;

a slot positioned within said hammer body, said slot extending between said hammer lug and said hammer face; and a catch surface positioned on said hammer body within said slot; and a sear mountable within said frame for pivoting motion about a sear pivot axis, said sear comprising:

a sear body defining a sear lug surrounding said sear pivot axis; and an action surface positioned on said sear body distal to said sear pivot axis, said action surface being movable into and out of engagement with said catch surface upon rotation of said sear body about said sear pivot axis, wherein at least a portion of said sear body is received within said slot.

2. The arrangement according to claim 1, wherein said hammer and said sear are mountable directly on said frame.

3. The arrangement according to claim 1, further comprising a housing surrounding said hammer and said sear, said hammer and said sear being pivotably mounted within said housing, said housing being mountable within said frame.

4. The arrangement according to claim 1, wherein said catch surface and said action surface are positioned along a centerline of said hammer body and said sear body.

5. The arrangement according to claim 1, wherein said hammer further comprises:

an opening extending through said hammer lug, said opening being aligned with said hammer pivot axis; and a hammer pivot pin extending through said opening, said hammer pivot pin being aligned with said hammer pivot axis.

6. The arrangement according to claim 1, wherein said sear further comprises:

an opening extending through said sear lug, said opening being aligned with said sear pivot axis; and a sear pivot pin extending through said opening, said sear pivot pin being aligned with said sear pivot axis.

7. The arrangement according to claim 1, wherein said hammer further comprises first and second hammer trunnions positioned on opposite sides of said hammer lug, said first and second hammer trunnions surrounding said hammer pivot axis.

8. The arrangement according to claim 1, wherein said sear further comprises first and second sear trunnions positioned on opposite sides of said sear lug, said first and second sear trunnions surrounding said sear pivot axis.

9. The arrangement according to claim 1, wherein said sear further comprises a sear tail positioned on an opposite side of said sear pivot axis from said action surface.

10. The arrangement according to claim 1, further comprising a hammer spring for biasing said hammer to pivot from a cocked position to a strike position.

11. The arrangement according to claim 10, wherein said hammer spring is adapted to act directly between said frame and said hammer body.

12. The arrangement according to claim 1, further comprising a sear spring for biasing said sear to pivot from a first position wherein said action surface is not engaged with said catch surface to a second position wherein said action surface is engaged with said catch surface.

13. The arrangement according to claim 12, wherein said sear spring is adapted to act directly between said frame and said sear body.

14. The arrangement according to claim 3, further comprising a hammer spring for biasing said hammer to pivot from a cocked position to a strike position, said hammer spring acting between said housing and said hammer body.

15. The arrangement according to claim 3, further comprising a sear spring for biasing said sear to pivot from a first position wherein said action surface is not engaged with said catch surface, to a second position wherein said action surface is engaged with said catch surface, said sear spring acting between said housing and said sear body.

16. The arrangement according to claim 7, further comprising:

a hammer spring for biasing said hammer to pivot from a cocked position to a strike position, said hammer spring comprising:

a first coil surrounding said first trunnion;

a second coil surrounding said second trunnion; and a bridge connecting said first and second coils, said bridge engaging said hammer body, wherein said first and second coils are adapted to react directly against said frame for biasing said hammer.

17. The arrangement according to claim 3, wherein said hammer further comprises first and second hammer trunnions positioned on opposite sides of said hammer lug, said first and second hammer trunnions surrounding said hammer pivot axis.

18. The arrangement according to claim 3, wherein said sear further comprises first and second sear trunnions positioned on opposite sides of said sear lug, said first and second sear trunnions surrounding said sear pivot axis.

19. A firearm comprising:

a frame;

a hammer pivotably mounted within said frame about a hammer pivot axis, said hammer comprising:

a hammer body defining a hammer lug surrounding said hammer pivot axis and a hammer face positioned distal to said hammer pivot axis;

a slot positioned within said hammer body, said slot extending between said hammer lug and said hammer face; and a catch surface positioned on said hammer body within said slot;

a sear pivotably mounted within said frame about a sear pivot axis, said sear comprising:

a sear body defining a sear lug surrounding said sear pivot axis; and an action surface positioned on said sear body distal to said sear pivot axis, said action surface being movable into and out of engagement with said catch surface upon rotation of said sear body about said sear pivot axis, wherein at least a portion of said sear body is received within said slot.

* * * * *